United States Patent [19]

Andersson

[11] 4,319,726

[45] Mar. 16, 1982

[54] COMBINED SACK HOLDER AND WEED REMOVAL IRON

[76] Inventor: Gustav V. Andersson, Ejdervägen 28, Saltsjö-Duvnäs, Sweden, 133 00

[21] Appl. No.: 750,398

[22] Filed: Dec. 14, 1976

[51] Int. Cl.[3] ..... B65B 67/12

[52] U.S. Cl. ..... 248/97; 171/43; 248/99; 248/156

[58] Field of Search ..... 248/99, 97, 156, 315, 248/300, 98, 101, 159, 530–532, 518; 171/43; 172/247, 766

[56] References Cited

U.S. PATENT DOCUMENTS

| | | | |
|---|---|---|---|
| 228,733 | 6/1880 | Curtiss et al. | 248/99 |
| 649,315 | 5/1900 | Klesse et al. | 248/99 |
| 666,045 | 1/1901 | Beeson | 248/99 X |
| 1,027,464 | 5/1912 | Dahlstrom | 248/97 |
| 2,152,018 | 3/1939 | Barnhart | 248/97 |
| 3,532,314 | 10/1970 | Vosbikian | 248/97 |
| 3,599,917 | 8/1971 | Schwartz | 248/156 X |
| 3,768,763 | 10/1973 | Hembree | 248/99 X |
| 3,796,402 | 3/1974 | Trotta | 248/97 |
| 3,838,839 | 10/1974 | Spencer | 248/97 X |
| 3,923,278 | 12/1975 | Marcil | 248/301 |
| 3,952,878 | 4/1976 | Gorham | 248/156 X |

FOREIGN PATENT DOCUMENTS

| | | | |
|---|---|---|---|
| 112715 | 1/1969 | Denmark | 248/97 |
| 233585 | 4/1911 | Fed. Rep. of Germany | 248/99 |
| 96577 | 10/1922 | Switzerland | 248/97 |
| 834177 | 5/1960 | United Kingdom | 248/156 |

*Primary Examiner*—Rodney H. Bonck
*Attorney, Agent, or Firm*—Larson and Taylor

[57] ABSTRACT

The device disclosed relates to a combined sack holder and weed removal iron. A ring of adjustable dimensions is mounted to the upper end of a bar to form a sack holder. At least the lower end of the bar is tubular to receive a shaft of a bifurcated weed removal iron.

2 Claims, 4 Drawing Figures

COMBINED SACK HOLDER AND WEED REMOVAL IRON

The present application relates to a combined sack holder and weed removal iron.

When removing weed, when taking up root-crop such as potatoes and the like, when raking together leaves and in a lot of other cases, one has a need of being capable of putting the said objects or products into a sack in an easy way. Especially often it happens that what should be collected in the sack is formed by weed, and one thereby also has a need for a weed removal iron of a type, known per se. However, there were difficulties to keep the sack and the sack holder in a vertical position. These difficulties are avoided according to the present invention, according to which the sack holder is provided with a vertical support bar, which at its lower end is possible to join to a weed removal iron, which can be put down into the body and thereby given the required support for the sack holder.

However, it also happens that in other cases one will use the same sack holder inside of a house, and that one will thereby either have it standing freely on a floor or one will hang it up on a wall.

The invention therefore also refers to accessories to the sack holder for making possible such a position on a floor or hanging on a wall.

According to the present invention the sack holder comprises a bar, which is in turn provided with a groove at its upper end when used. This groove runs at least approximately in the diametrical direction through the bar. The groove is intended to receive a bandformed, composite ring contained in the sack holder. When mounting a sack its mouth is placed inside of said ring, and its edges are bent over, so that they are positioned outside of the ring. The bar is, at least at its lower end, tubeformed in order of receiving a shaft of the weed removal iron, replacing the otherwise normally existing handle, or alternatively a corresponding boltformed shaft on a foot ring.

When attaching the sack holder to the wall, one has to remove the first mentioned upper ring from the bar of the sack holder, and the ring is instead placed into a groove in a holder, comprising a U-formed piece, the middle part of which is attached to the wall, and the two shanks of which are provided with grooves, corresponding to the groove existing in the upper end of the bar, for receiving the carrier ring for the sack.

This invention is further shown in the attached drawing, which shows one form of execution of the utility design. However, it is understood that the design is not strictly bound to the form of execution shown in the drawing, but that different modifications may occur within the frame of the protection.

In the drawing

Figure 1:
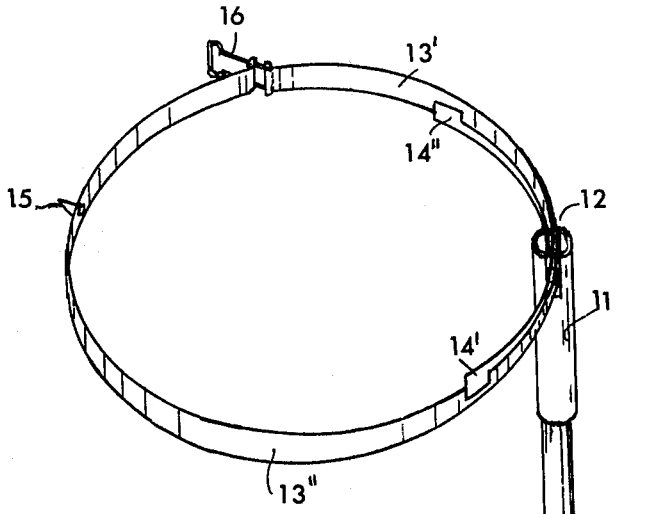
FIG. 1 shows the sack holder in mounted state for standing on the body.

The bar, which, when the sack holder is standing on the floor, carries up the sack, is indicated by 10 in the drawing. At its upper end it is provided with a solid part 11, which is of greater diameter than the remaining parts of the bar. These remaining parts of the bar are tubeformed, and, as stated, the upper part 11 is solid.

The thicker part 11, at its free end contains a diametrically extending groove 12, in which one, when using the sack holder, puts in the bandformed ring. This is assumed in the form of execution shown to comprise two parts 13' and 13'', which within the range of the thicker part 11 of the bar 10 and on each side thereof, overlap each other. The ring parts 13' and 13'' at their free ends are provided with claws 14' and 14'' respectively, or similar arrangements, so shaped that the one claw 14' will embrace the other band part 13'' and the other claw 14'' will embrace the first mentioned band part 13'.

The one bandformed part, e.g. the part 13'' is longer than the other bandformed part 13'. At a place of the first mentioned bandformed part 13'', which is situated about opposite to the attachment place for the two parts 13' and 13'' in the thicker part 11 of the bar 10, more closely in the groove 12, provided in the last mentioned part, an outwardly directed point 15 is provided. This has proved to be of very great importance. When attaching a jute sack or some sack of any other material with a tendency, after having been applied into the interior of the ring, and after the edge has been turned over along the outside of the ring, to slide out of its engagement with the ring, and the engagement between the point 15 and the material of the sack prevents such sliding out.

Many materials, used for sacks have a tendency to shrink, after they have been wet and again been allowed to dry. Such sacks, which are produced by a textile material by sewing, also often show small variations regarding their measures, especially at the circumference of their mouthes. This, in first place, regards all such textile sacks, which are provided with a mouth reinforcement. Then it may be difficult to mount such a sack of increased mouth circumference on a sack holder of the above mentioned type. As a matter of fact, one desires to avoid readjustment of the overlap meshing between the two ring parts 13' and 13''.

For avoiding this disadvantage a clamping device 16 has been provided at the place, where the free ends of the two ring parts 13' and 13'' meet. This clamping device, which, of course is known per se, comprises an arm acting as a level, said arm at its one end being guidably combined with the end of the one band 13', at an intermediate place being guidably connected to the end of the other band 13'', and finally being available for turning at its free end. By turning this arm in clockwise direction one can thus minimize the circumference of the bands 13' and 13'' when the first mounting of the sack in order thereafter to turn the clamping arm counter-clockwise, whereby the combined circumference of the bands is increased, the sack is clamped, and the meshing between the sack and the point 15 is made sure.

Figure 1A:
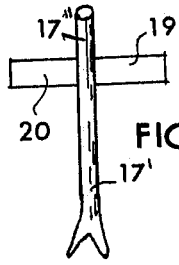

The bar 10, as mentioned above, is tubeformed in its lower part. In this tube one has introduced the shaft part 17'' of the weed removal iron 17', shown in FIG. 1*a*, and thereafter the weed removal iron is locked by introducing a locking bolt 18. The weed removal iron 17 is provided with a couple of treadles 19, 20, by means of which one can easily press the weed removal iron into the body.

When mounting the sack holder inside of a house, for instance on a floor, one will use a foot, which in the shown form of execution comprises a ring 21, with which, for instance by welding, a bolt 22 of such a diameter that it will pass into the tubeformed, lower end of the bar 10, has been attached in a direction perpendicular to the level of the ring. One then has to remove the weed removal iron 17 from the sack holder according to FIG. 1 after having removed the locking bolt 18 and instead one places the bolt 22 of the foot 21 into the tube, and locks this by means of the bolt 18.

Figure 3:
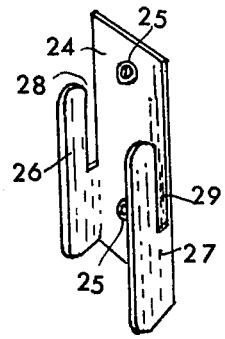
FIG. 3 shows the attachment piece for hanging the sack holder on a wall.
Figure 2:
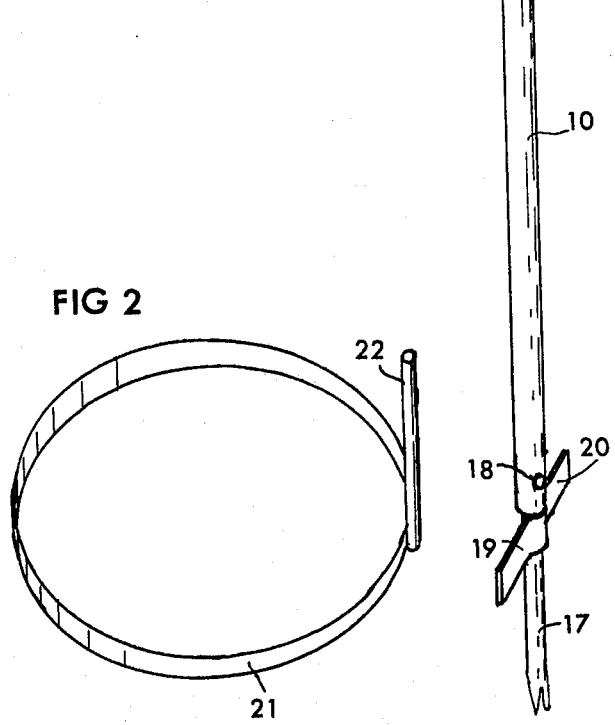
FIG. 2 shows the foot for mounting the sack holder on a floor.

When attaching the sack holder on a wall, one will use the fixture means, shown in FIG. 3. This comprises an U-formed bent part of some suitable metal, the bottom 24 of which is provided with screw holes 25 for its attachment to the wall. The two shanks 26 and 27 of the U-formed bent part 24-26-27 are at their lower parts rigidly connected to the bottom 24 of said part, but at their upper parts they are separated from said bottom by means of slots 28, 29, which, at to their width are so adapted that one may after having released the ring 13 from the bar 10, instead introduced this ring 13 into the slots 28 and 29.

I claim:

1. A combined sack holder and weed removal device, said device comprising an elongate bar member, a ring supported at the upper end of the bar member for holding a sack for collecting waste material and the like, said bar member including a groove at the upper end thereof in which said ring is received, and said ring comprising first and second parts which overlap one another within the width of the groove and for a small additional distance on each side of the groove, said first and second parts comprising a longer part and a shorter part, an outwardly directed point on said longer part at a location opposite to the groove of the bar member and means for connecting said first and second ring parts together so as to enable variation in the circumference of the ring to thereby accommodate sacks of different sized openings, said connecting means comprising a clamping device for bounding said parts together at the ends thereof opposite ends which overlap so as to enable the circumference of the ring to be made greater or smaller, said bar member being of tubular form at the lower end thereof and said device further comprising an elongate removable weed removal member detachably received at one end thereof in the lower end of the bar member, said weed removal member including a bifurcated weed removal tool at the other end thereof and at least one step affixed to said weed removal member intermediate the ends thereof for enabling pressing of the weed removal tool into the earth, said tubular form lower end of said bar member including a hole extending therethrough and said device further comprising a locking pin removably received in said hole for holding said weed removal tool in place in said lower end of said bar member and for permitting removal and replacement of said weed removal tool.

2. A sack holder with weed removal iron according to claim 1, in which the weed removal tool is provided with steps extending in both directions.

* * * * *